US012571146B2

(12) United States Patent
Zhang et al.

(10) Patent No.: US 12,571,146 B2
(45) Date of Patent: Mar. 10, 2026

(54) WASHING MACHINE ABNORMAL SOUND DETECTION METHOD AND APPARATUS, ELECTRONIC DEVICE, AND STORAGE MEDIUM

(71) Applicants: COSMO INSTITUTE OF INDUSTRIAL INTELLIGENCE (QINGDAO) CO., LTD., Shandong (CN); HAIER COSMO IOT TECHNOLOG CO., LTD., Shandong (CN); HAIER DIGITAL TECHNOLOGY (QINGDAO) CO., LTD., Shandong (CN)

(72) Inventors: Chenglong Zhang, Shandong (CN); Wenyao Huang, Shandong (CN); Qi Dong, Shandong (CN); Jingchao Zhou, Shandong (CN); Ming Sun, Shandong (CN); Zhiyuan Li, Shandong (CN); Bangguo Zhou, Shandong (CN)

(73) Assignees: Cosmo Institute of Industrial Intelligence (Qingdao) Co., Ltd., Qingdao (CN); Haier Cosmo IOT Technolog Co., Ltd., Qingdao (CN); Haier Digital Technology (Qingdao) Co., Ltd., Qingdao (CN)

( * ) Notice: Subject to any disclaimer, the term of this patent is extended or adjusted under 35 U.S.C. 154(b) by 115 days.

(21) Appl. No.: 18/563,363

(22) PCT Filed: Jan. 20, 2023

(86) PCT No.: PCT/CN2023/073311

§ 371 (c)(1),
(2) Date: Nov. 21, 2023

(87) PCT Pub. No.: WO2023/093919

PCT Pub. Date: Jun. 1, 2023

(65) Prior Publication Data

US 2024/0287724 A1 Aug. 29, 2024

(30) Foreign Application Priority Data

Nov. 26, 2021 (CN) ..... 202111423244.7

(51) Int. Cl.
*D06F 33/47* (2020.01)
*D06F 33/48* (2020.01)
(Continued)

(52) U.S. Cl.
CPC ..... *D06F 33/47* (2020.02); *D06F 33/48* (2020.02); *D06F 33/74* (2020.02); *D06F 33/76* (2020.02);
(Continued)

(58) Field of Classification Search
CPC ..... D06F 33/47; D06F 33/48; D06F 33/74; D06F 33/76; D06F 34/16; D06F 34/20;
(Continued)

(56) References Cited

U.S. PATENT DOCUMENTS 9,971,667 B1 5/2018 Jenkins et al.
10,475,468 B1 11/2019 Yelchuru et al.
(Continued)

FOREIGN PATENT DOCUMENTS

CN 103138980 A 6/2013
CN 104122094 A 10/2014
(Continued)

OTHER PUBLICATIONS

Machine translation of CN 104122094 A to Liu et al. (Year: 2014).*
(Continued)

*Primary Examiner* — Joseph L. Perrin
(74) *Attorney, Agent, or Firm* — ArentFox Schiff LLP

(57) ABSTRACT

Provided are a washing machine abnormal sound detection method and apparatus, an electronic device, and a storage medium. The method includes acquiring target sound data
(Continued)

and target vibration data of a to-be-detected washing machine; selecting a matching sound analysis algorithm and a matching vibration analysis algorithm to analyze the target sound data and the target vibration data according to device identification information of the to-be-detected washing machine; determining the position at which an abnormal sound is generated in the to-be-detected washing machine and the cause of the abnormal sound according to the sound data analysis result and the vibration data analysis result.

15 Claims, 3 Drawing Sheets

(51) Int. Cl.

| | |
|---|---|
| ***D06F 33/74*** | (2020.01) |
| ***D06F 33/76*** | (2020.01) |
| ***D06F 34/16*** | (2020.01) |
| ***D06F 34/20*** | (2020.01) |
| *D06F 35/00* | (2006.01) |
| *D06F 103/26* | (2020.01) |
| *D06F 105/58* | (2020.01) |

(52) U.S. Cl.
CPC ..... *D06F 34/16* (2020.02); *D06F 34/20* (2020.02); *D06F 35/00* (2013.01); *D06F 2103/26* (2020.02); *D06F 2105/58* (2020.02)

(58) Field of Classification Search
CPC ... D06F 35/00; D06F 2103/26; D06F 2105/58
See application file for complete search history.

(56) References Cited

U.S. PATENT DOCUMENTS

2003/0037382 A1* 2/2003 Broker ..... D06F 33/48 68/12.02
2005/0114081 A1* 5/2005 Fukui ..... G01N 29/4445 702/182
2009/0282874 A1* 11/2009 Lee ..... H04K 3/825 68/12.12
2018/0023236 A1* 1/2018 Odashima ..... G06N 3/08 706/12
2021/0349897 A1 11/2021 Pierri et al.

FOREIGN PATENT DOCUMENTS

| | | | |
|---|---|---|---|
| CN | 105698919 | A | 6/2016 |
| CN | 107703822 | A | 2/2018 |
| CN | 109187029 | A | 1/2019 |
| CN | 109297582 | A | 2/2019 |
| CN | 109658954 | A | 4/2019 |
| CN | 110132405 | A | 8/2019 |
| CN | 110867195 | A | 3/2020 |
| CN | 111397725 | A | 7/2020 |
| CN | 111457434 | A | 7/2020 |
| CN | 112324629 | A | 2/2021 |
| CN | 112899971 | A | 6/2021 |
| CN | 113314142 | A | 8/2021 |
| CN | 113421588 | A | 9/2021 |
| CN | 113838480 | A | 12/2021 |
| JP | 2020126021 | A | 8/2020 |

OTHER PUBLICATIONS

English Abstract; Bin et al., "Experimental Study on Operational Vibration & Noise of the Series Excited Motor in Washing Machine," IEEE, 2010, 5 pages.
English Translation of International Search Report from corresponding PCT/CN2023/073311, Jun. 16, 2023, 6 pages.
English Abstract; Li et al., "Abnormal sound detection of washing machine based on deep learning," Journal of Shandong University (Engineering Science), Apr. 2020, vol. 50, No. 2, pp. 108-117.
English Translation of Office Action in CN 202111423244.7, Jun. 1, 2022, 4 pages.

* cited by examiner

WASHING MACHINE ABNORMAL SOUND DETECTION METHOD AND APPARATUS, ELECTRONIC DEVICE, AND STORAGE MEDIUM

CROSS REFERENCE TO RELATED APPLICATION(S)

This application is a national stage application filed under 35 U.S.C. 371 based on International Patent Application No. PCT/CN2023/073311, filed on Jan. 20, 2023, which claims priority to Chinese Patent Application No. 202111423244.7, filed with the China National Intellectual Property Administration (CNIPA) on Nov. 26, 2021, the disclosures of both of which are incorporated herein by reference in their entireties.

The present application claims priority to Chinese Patent Application No. 202111423244.7 filed with the China National Intellectual Property Administration (CNIPA) on Nov. 26, 2021, the disclosure of which is incorporated herein by reference in its entirety.

TECHNICAL FIELD

Embodiments of the present application relate to the technical field of abnormal sound detection, for example, a washing machine abnormal sound detection method and apparatus, an electronic device, and a storage medium.

BACKGROUND

Abnormal sound is an important indicator to measure the quality of washing machines. However, manual detection and manual recording are mostly used in abnormal detection on the production line of washing machines. Manual abnormal sound detection is easily affected by subjective factors, resulting in low detection accuracy. Moreover, workers after a long-term detection are prone to auditory fatigue, resulting in problems such as false detection and missed detection, which seriously affects the production efficiency and automation level of the production line. To achieve automatic detection of abnormal sound of washing machines, some abnormal sound detection systems are applied. However, the detection accuracy of the current abnormal sound detection system is not high due to the influence of the noise generated by the vibration of working washing machines on the abnormal sound detection system. In addition, although capable of detecting the abnormal sound of washing machines, abnormal sound detection systems cannot analyze the cause of the abnormal sound, and manual assistance is required to instruct work like subsequent maintenance of substandard products.

SUMMARY

Embodiments of the present application provide a washing machine abnormal sound detection method and apparatus, an electronic device, and a storage medium, and in combination with the results of sound detection and vibration detection, determine the position and cause of the abnormal sound, thereby improving the accuracy of detecting abnormal sound.

An embodiment of the present application provides a washing machine abnormal sound detection method. The method includes acquiring target sound data and target vibration data of a to-be-detected washing machine; selecting a matching sound analysis algorithm and a matching vibration analysis algorithm to analyze the target sound data and the target vibration data according to device identification information of the to-be-detected washing machine; determining the position at which an abnormal sound is generated in the to-be-detected washing machine and the cause of the abnormal sound according to the sound data analysis result and the vibration data analysis result.

An embodiment of the present application provides a washing machine abnormal sound detection apparatus. The apparatus includes a data acquisition module, a data analysis module, and an abnormal sound position and cause determination module.

The data acquisition module is configured to acquire target sound data and target vibration data of a to-be-detected washing machine.

The data analysis module is configured to select a matching sound analysis algorithm and a matching vibration analysis algorithm to analyze the target sound data and the target vibration data according to device identification information of the to-be-detected washing machine.

The abnormal sound position and cause determination module is configured to determine the position at which an abnormal sound is generated in the to-be-detected washing machine and the cause of the abnormal sound according to the sound data analysis result and the vibration data analysis result.

An embodiment of the present application also provides an electronic device. The device includes one or more processors and a memory.

The memory is configured to store one or more programs.

When executed by the one or more processors, the one or more programs cause the one or more processors to implement the washing machine abnormal sound detection method of any embodiment of the present application.

An embodiment of the present application provides a computer-readable storage medium. The computer-readable storage medium stores a computer program which, when executed by a processor, implements the washing machine abnormal sound detection method of any embodiment of the present application.

DETAILED DESCRIPTION

Figure 1:
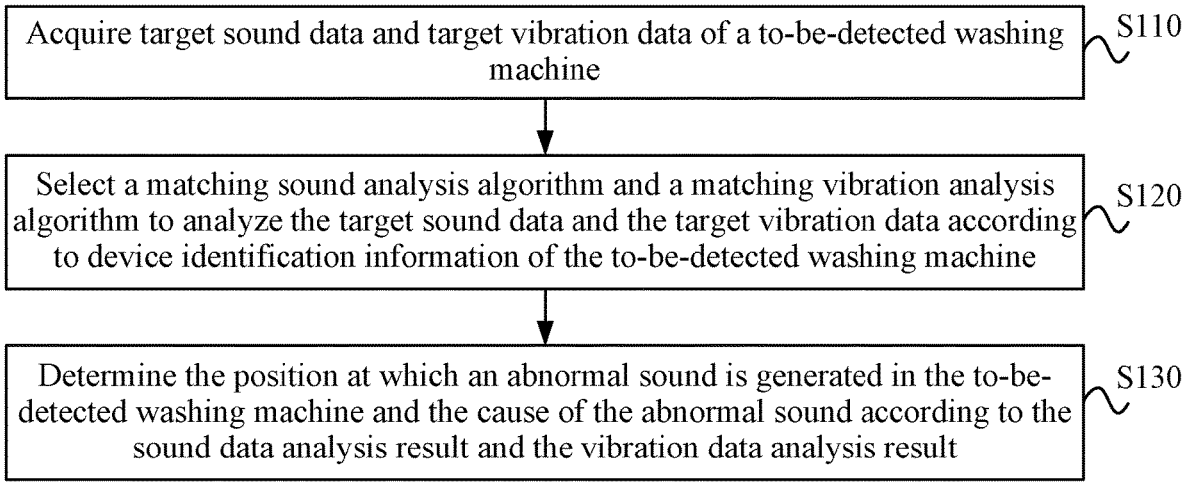
FIG. 1 is a flowchart of a washing machine abnormal sound detection method according to embodiment one of the present application.

Hereinafter the present application is described in detail in conjunction with drawings and embodiments. It can be understood that the specific embodiments set forth below are intended to explain the present application. Additionally, it is to be noted that for ease of description, only part, not all, of structures related to the present application are illustrated in the drawings.

Before exemplary embodiments are discussed in more detail, it is to be noted that some of the exemplary embodiments are described as processes or methods depicted in flowcharts. Although the flowcharts describe the operations (steps) as sequential processes, many of the operations (steps) may be implemented concurrently, coincidently, or simultaneously. Additionally, the sequence of the operations may be rearranged. Each of the processes may be terminated when the operations are completed but may further have additional steps not included in the drawings. Each of the processes may correspond to one of a method, a function, a procedure, a subroutine, a subprogram, etc.

Embodiment One

FIG. 1 is a flowchart of a washing machine abnormal sound detection method according to embodiment one of the present application. This embodiment is applicable to the detection of abnormal sound of a washing machine. The method of this embodiment may be executed by a washing machine abnormal sound detection apparatus. The apparatus may be implemented in the form of software and/or hardware. The apparatus may be configured in a server for abnormal sound detection of a washing machine. The method includes the steps described below.

S110: Target sound data and target vibration data of a to-be-detected washing machine are acquired.

In this embodiment, the target sound data may refer to sound data emitted by the to-be-detected washing machine after the to-be-detected washing machine is started, for example, a sound emitted by the motor after the to-be-detected washing machine is started.

The target vibration data may refer to data generated by the to-be-detected vibration after the to-be-detected washing machine is started, for example, vibration data generated when the drum of the to-be-detected washing machine rotates.

Each part of the washing machine contains at least one sensor to collect the target vibration data and the target sound data of the washing machine in real time.

S120: A matching sound analysis algorithm and a matching vibration analysis algorithm are selected to analyze the target sound data and the target vibration data according to device identification information of the to-be-detected washing machine.

In this embodiment, the device identification information may refer to a token used for identifying different models or different batches of washing machines. For example, the device identification information of the washing machine is acquired by using an image collection device. The device identification information at least includes the model of the washing machine and the batch number of the washing machine.

In an example, the device identification information of the washing machine is acquired by using an image collection device, the acquired image is transmitted to a machine vision system to acquire a product model of the washing machine, and a matching sound analysis algorithm and a matching vibration analysis algorithm are selected according to different models of washing machines, where the sound analysis algorithm and the vibration analysis algorithm are automatically matched by an abnormal sound detection algorithm platform; the abnormal sound detection algorithm platform matches different sound analysis algorithms and vibration analysis algorithms according to different models of the washing machines to analyze the target sound data and the target vibration data.

In an example, the device identification information of the washing machine is acquired by using an image collection device, and the acquired image is transmitted to a machine vision system to acquire the product batch number of the washing machine. For washing machines belonging to the same batch, different sound analysis algorithms and vibration analysis algorithms are matched in the abnormal sound detection algorithm platform according to different batch numbers of washing machines to analyze the target sound data and the target vibration data.

In this embodiment, analyzing the target sound data and the target vibration data may refer to performing time-frequency analysis on the collected target sound data and the target vibration data. For example, chromatogram analysis is performed on the target sound data by using a sound analysis algorithm, and envelope analysis is performed on the target vibration data by using a vibration analysis algorithm.

S130: The position at which an abnormal sound is generated in the to-be-detected washing machine and the cause of the abnormal sound are determined according to the sound data analysis result and the vibration data analysis result.

In this embodiment, it is determined whether the sound data analysis result and the vibration data analysis result are both acceptable. It is determined that the to-be-detected washing machine is up to standard when determining that both the sound data analysis result and the vibration data analysis result are acceptable. It is determined that the to-be-detected washing machine is substandard when determining that at least one of the sound data analysis result or the vibration data analysis result is unacceptable.

For the substandard to-be-detected washing machine, the position at which the abnormal sound is generated in the to-be-detected washing machine and the cause of the abnormal sound are determined according to the sound data analysis result, the vibration data analysis result, and a mechanism model of the to-be-detected washing machine; the maintenance personnel are reminded to maintain the substandard to-be-detected washing machine according to the cause and the position of the abnormal sound.

The embodiment of the present application provides a washing machine abnormal sound detection method. In this method, target sound data and target vibration data of a to-be-detected washing machine are acquired; a matching sound analysis algorithm and a matching vibration analysis algorithm are selected to analyze the target sound data and the target vibration data according to device identification information of the to-be-detected washing machine; the position at which an abnormal sound is generated in the to-be-detected washing machine and the cause of the abnormal sound are determined according to the sound data analysis result and the vibration data analysis result. The device identification information of the to-be-detected washing machine is collected by an image collection device, an abnormal sound detection algorithm platform automatically matches a sound analysis algorithm and a vibration analysis algorithm to analyze the target sound data and the target vibration data, and the position at which an abnormal sound is generated in the to-be-detected washing machine and the cause of the abnormal sound are determined. In this manner, the accuracy of detecting abnormal sound is improved. Moreover, the maintenance personnel are guided to maintain a substandard to-be-detected washing machine according to the mechanism model of the to-be-detected washing machine. In the embodiment of the present application, the position at which the abnormal sound is generated and the cause of the abnormal sound are determined according to the sound data analysis result, the vibration data analysis result, and the mechanism model of the washing machine, thereby improving the accuracy of detecting abnormal sound.

Embodiment Two

Figure 2:
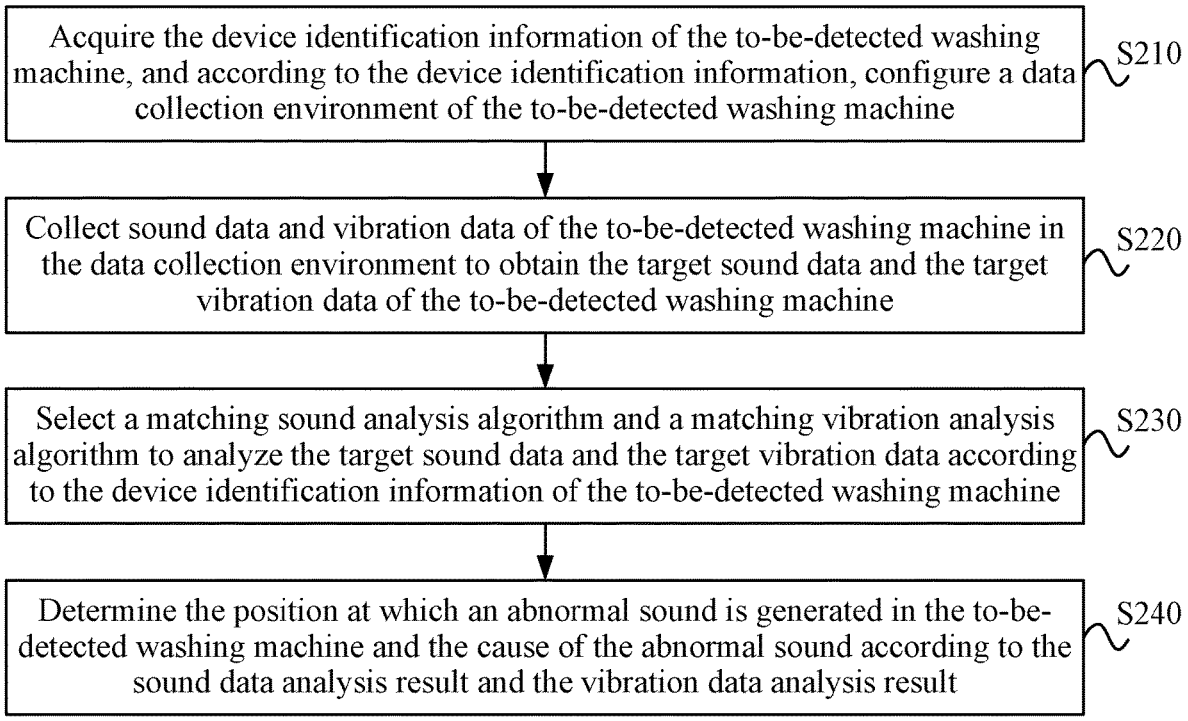
FIG. 2 is a flowchart of a washing machine abnormal sound detection method according to embodiment two of the present application.

FIG. 2 is a flowchart of a washing machine abnormal sound detection method according to embodiment two of the present application. This embodiment of the present application optimizes the preceding embodiments based on the preceding embodiments and may be combined with various alternative solutions in the preceding one or more embodiments. As shown in FIG. 2, the washing machine abnormal sound detection method according to this embodiment of the present application may include the steps described below.

S210: The device identification information of the to-be-detected washing machine is acquired, and according to the device identification information, a data collection environment of the to-be-detected washing machine is configured.

In this embodiment, the device identification information of the to-be-detected washing machine is acquired by a machine vision system, and according to the acquired device identification information, a data collection environment of the to-be-detected washing machine is configured. It is determined whether the currently configured data collection environment satisfies a collection condition. Criteria include parameters such as sampling frequency, sampling digit, digit, and ambient noise. The data of the to-be-detected washing machine is collected when determining that the currently configured data collection environment satisfies the collection condition; or a collection environment is reconfigured until the collection condition is satisfied when determining that the currently configured data collection environment does not satisfy the collection condition.

In an exemplary embodiment, a barcode image of a washing machine is acquired by using an image collection device, the barcode image is transmitted to the machine vision system, and the device identification information of the to-be-detected washing machine is acquired.

According to the acquired device identification information of the to-be-detected washing machine, the data collection environment of the to-be-detected washing machine is configured, and it is determined whether the currently configured data collection environment satisfies a collection condition.

The target sound data and the target vibration data of the to-be-detected washing machine are acquired when determining that the currently configured data collection environment satisfies the collection condition. Alternatively, a collection environment is reconfigured until the collection condition is satisfied when determining that the currently configured data collection environment does not satisfy the collection condition.

Determining whether the currently configured data collection environment satisfies the collection condition includes determining whether a sampling frequency, a sampling digit, and ambient noise of the to-be-detected washing machine satisfy a preset collection condition.

The device identification information of the to-be-detected washing machine is acquired by the image collection device, the data collection environment of the to-be-detected washing machine is configured according to the device identification information, and it is determined whether the currently configured data collection environment satisfies a collection condition. The data collection environment is configured because the parameters of to-be-detected washing machines are different. Different collection environments are determined according to different device identification information of to-be-detected washing machines.

S220: Sound data and vibration data of the to-be-detected washing machine are collected in the data collection environment to obtain the target sound data and the target vibration data of the to-be-detected washing machine.

In an exemplary embodiment, vibration detection is performed on the base of the to-be-detected washing machine fixed by a hydraulic apparatus in the to-be-detected washing machine to acquire base vibration data of the to-be-detected washing machine, and model information of the base of the to-be-detected washing machine is acquired by a radio frequency identification technology.

The collected base vibration data are compared with historical base vibration data in a data library, and it is determined whether the collected base vibration data matches the historical base vibration data.

When determining that the collected base vibration data matches the historical base vibration data, the base vibration data are analyzed.

When determining that the collected base vibration data does not match the historical base vibration data, the base vibration data are eliminated, and the historical base vibration data are used as new base vibration data to obtain the target vibration data of the to-be-detected washing machine.

In this embodiment, during the data collection process, a hydraulic apparatus is used for fixing the base of the washing machine, and the model of the base of the to-be-detected washing machine is collected by the radio frequency identification technology. The collected base vibration data are compared with historical base vibration data in a data library, and it is determined whether the collected base vibration data matches the historical base vibration data. When determining that the collected base vibration data matches the historical base vibration data, the base vibration data are analyzed the target vibration data are analyzed. When determining that the collected base vibration data does not match the historical base vibration data, the collected base vibration data regarded as noise data are eliminated, and it is determined whether the noise data are eliminated; the base vibration data are analyzed when the noise data are eliminated, and the elimination of the noise data is continued when the noise data are not eliminated.

S230: A matching sound analysis algorithm and a matching vibration analysis algorithm are selected to analyze the target sound data and the target vibration data according to the device identification information of the to-be-detected washing machine.

S240: The position at which an abnormal sound is generated in the to-be-detected washing machine and the cause of the abnormal sound are determined according to the sound data analysis result and the vibration data analysis result.

The embodiment of the present application provides a washing machine abnormal sound detection method. In this method, the device identification information of the to-be-detected washing machine is acquired by a machine vision system, and according to the acquired device identification information, a data collection environment of the to-be-detected washing machine is configured; the base of the to-be-detected washing machine is fixed by using a hydraulic apparatus, and the device identification information of the to-be-detected washing machine is acquired by the radio frequency identification technology. According to the matching degree between the collected base vibration data and the historical base vibration data, the generated vibration noise is eliminated, the influence of vibration noise on the abnormal sound detection is eliminated, and the accuracy of detecting abnormal sound is improved. Moreover, a matching sound analysis algorithm and a matching vibration analysis algorithm are selected to analyze the target sound data and the target vibration data according to device identification information of the to-be-detected washing machine; the position at which an abnormal sound is generated in the to-be-detected washing machine and the cause of the abnormal sound are determined according to the sound data analysis result and the vibration data analysis result so that the maintenance personnel are guided in time to maintain the substandard to-be-detected washing machine.

Embodiment Three

Figure 3:
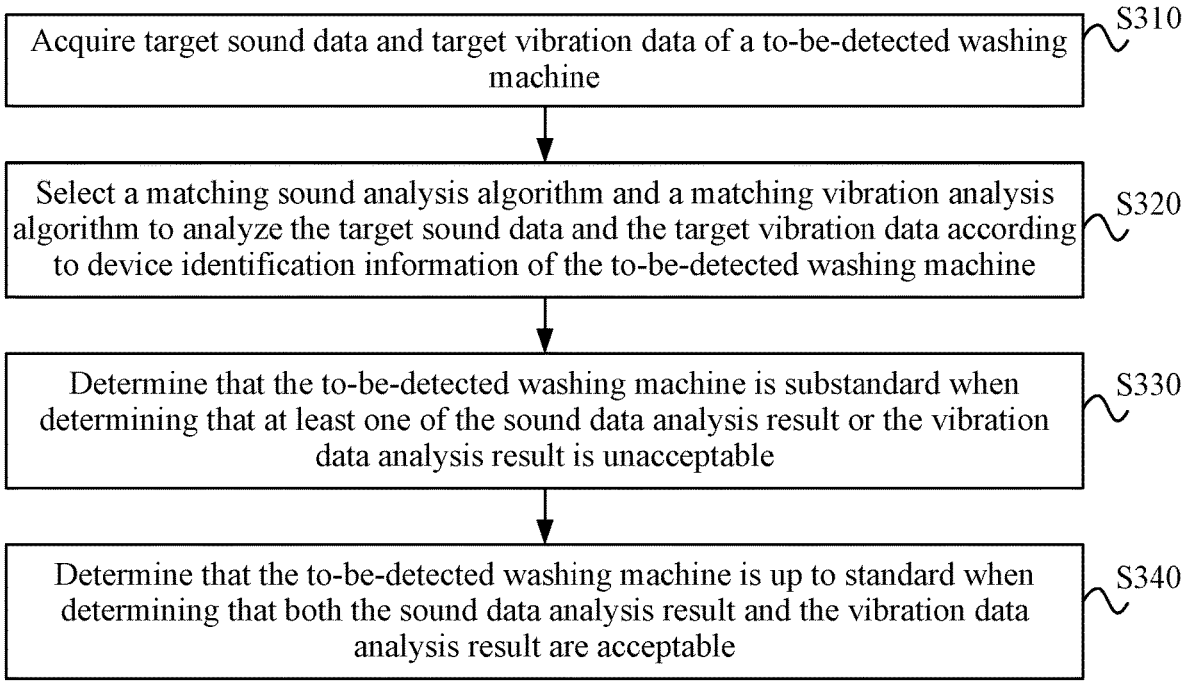
FIG. 3 is a flowchart of a washing machine abnormal sound detection method according to embodiment three of the present application.

FIG. 3 is a flowchart of a washing machine abnormal sound detection method according to embodiment three of the present application. This embodiment of the present application optimizes the preceding embodiments based on the preceding embodiments and may be combined with various alternative solutions in the preceding one or more embodiments. As shown in FIG. 3, the washing machine abnormal sound detection method according to this embodiment of the present application may include the steps described below.

S310: Target sound data and target vibration data of a to-be-detected washing machine are acquired.

S320: A matching sound analysis algorithm and a matching vibration analysis algorithm are selected to analyze the target sound data and the target vibration data according to device identification information of the to-be-detected washing machine.

In this embodiment, according to the device identification information of the to-be-detected washing machine, the abnormal sound detection algorithm platform automatically matches a sound analysis algorithm and a vibration analysis algorithm of the corresponding model; the sound analysis algorithm and the vibration analysis algorithm perform time-frequency analysis on the collected sound data and vibration data; the sound analysis algorithm performs chromatogram analysis on the collected sound data to generate an abnormal sound detection result, and the vibration analysis algorithm performs envelope analysis on the collected vibration data to generate an abnormal sound detection result.

In an exemplary embodiment, the matching sound analysis algorithm is selected to perform chromatogram analysis on the target sound data to generate the sound data analysis result; the matching vibration analysis algorithm is selected to perform envelope analysis on the target vibration data to generate the vibration data analysis result.

In this embodiment, abnormal sound usually has certain characteristics, and a data-driven deep learning training model is used for training and performing feature extraction on various collected sound data to establish a voiceprint database. The sound data include fricative sounds and resonance sounds. The voiceprint database includes chromatograms. The collected sound data chromatogram is compared with the chromatogram in the voiceprint database to find out whether abnormal sound exists, and based on the characteristics of different abnormal sound chromatograms, the frequency of abnormal sound is limited within a certain range to obtain the type of the abnormal sound. For example, the noise frequency range of the bearing of the to-be-detected washing machine is 2000 Hz to 5000 Hz. If the noise frequency of the collected target sound data of the bearing is not in the range of 2000 Hz to 5000 Hz, the bearing of the to-be-detected washing machine has abnormal sound.

The envelope analysis of the target vibration data is to compare signal characteristics of the normal envelope and the abnormal envelope, and it is determined whether abnormal sound exists by the determination of the sound pressure of the envelope. For example, under normal circumstances, the sound pressure of the envelope is −0.3-0.3 Pa. If the sound pressure of the envelope of the target vibration data is not within the range of −0.3-0.3 Pa, it is determined that the target vibration data are abnormal, and the abnormal sound is a scratching sound.

S330: It is determined that the to-be-detected washing machine is substandard when determining that at least one of the sound data analysis result or the vibration data analysis result is unacceptable.

In this embodiment, the sound data analysis result and the vibration data analysis result are determined, and the to-be-detected washing machine is substandard in the following conditions: The sound data analysis result is unacceptable but the vibration data analysis result is acceptable; the sound data analysis result is acceptable but the vibration data analysis result is unacceptable; the sound data analysis result and the vibration data analysis result are both unacceptable.

In an exemplary embodiment, the position at which the abnormal sound is generated in the to-be-detected washing machine and the cause of the abnormal sound are determined according to the sound data analysis result, the vibration data analysis result, and the mechanism model of the to-be-detected washing machine.

The mechanism model of the to-be-detected washing machine includes an accurate distribution of multiple structures of a washing machine.

Information of the substandard to-be-detected washing machine is uploaded to a manufacturing execution system and a database, and the information of the substandard to-be-detected washing machine is stored. The information of the substandard to-be-detected washing machine at least includes the device identification information, data collection environment information, the target sound data, the target vibration data, the sound data analysis result, and the vibration data analysis result.

The substandard to-be-detected washing machine is maintained according to the position at which the abnormal sound is generated in the to-be-detected washing machine and the cause of the abnormal sound.

It is determined that the to-be-detected washing machine is substandard when determining that at least one of the sound data analysis result or the vibration data analysis result is unacceptable. Moreover, the device identification information of the substandard to-be-detected washing machine, the collected target vibration data, the collected target sound data, the sound data analysis result, the vibration data analysis result, and other information are uploaded to a manufacturing execution system and a database to store the data information, and the position at which the abnormal sound exists is determined according to the mechanism model of the to-be-detected washing machine.

S340: It is determined that the to-be-detected washing machine is up to standard when determining that both the sound data analysis result and the vibration data analysis result are acceptable.

It is determined that the to-be-detected washing machine is up to standard in the case where both the sound data analysis result and the vibration data analysis result are acceptable. The information of the to-be-detected washing machine that is up to standard is uploaded to the manufacturing execution system and the database, and the information of the to-be-detected washing machine that is up to standard is stored. The information of the to-be-detected washing machine that is up to standard at least includes the device identification information, data collection environment information, the target sound data, the target vibration data, the sound data analysis result, and the vibration data analysis result.

This embodiment of the present application provides a washing machine abnormal sound detection method. In this method, target sound data and target vibration data of a to-be-detected washing machine are acquired; according to device identification information of the to-be-detected washing machine, an abnormal sound detection algorithm platform automatically matches a sound analysis algorithm and a vibration analysis algorithm of the corresponding model; the sound analysis algorithm and the vibration analysis algorithm perform time-frequency analysis on collected sound data and vibration data; the sound analysis algorithm performs chromatogram analysis on the collected sound data and the vibration analysis algorithm performs envelope analysis on the collected vibration data to generate an abnormal sound detection result; it is determined that the to-be-detected washing machine is up to standard when determining that both the sound data analysis result and the vibration data analysis result are acceptable; it is determined that the to-be-detected washing machine is substandard when determining that at least one of the sound data analysis result or the vibration data analysis result is unacceptable, and the position at which the abnormal sound is generated in the to-be-detected washing machine and the cause of the abnormal sound are determined according to the sound data analysis result, the vibration data analysis result, and a mechanism model of the to-be-detected washing machine so that the maintenance personnel are reminded in time to maintain the substandard to-be-detected washing machine. Moreover, the device identification information of the to-be-detected washing machine, the data collection environment information, the target sound data, the target vibration data, the sound data analysis result, the vibration data analysis results, and other information are uploaded to the manufacturing execution system and the database for data storage.

Embodiment Four

Figure 4:
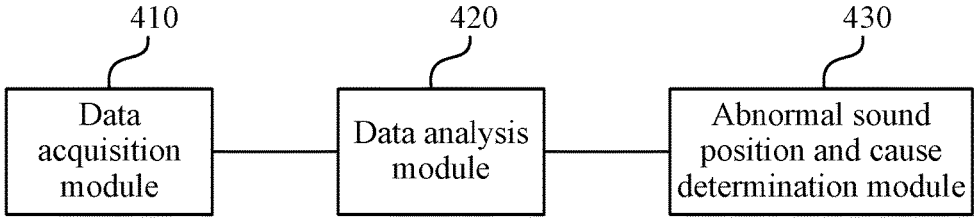
FIG. 4 is a diagram illustrating the structure of a washing machine abnormal sound detection apparatus according to embodiment four of the present application.

FIG. 4 is a diagram illustrating the structure of a washing machine abnormal sound detection apparatus according to embodiment four of the present application. The apparatus includes a data acquisition module 410, a data analysis module 420, and an abnormal sound position and cause determination module 430.

The data acquisition module 410 is configured to acquire target sound data and target vibration data of a to-be-detected washing machine.

The data analysis module 420 is configured to select a matching sound analysis algorithm and a matching vibration analysis algorithm to analyze the target sound data and the target vibration data according to device identification information of the to-be-detected washing machine.

The abnormal sound position and cause determination module 430 is configured to determine a position at which an abnormal sound is generated in the to-be-detected washing machine and a cause of the abnormal sound according to the sound data analysis result and the vibration data analysis result.

Based on the preceding embodiments, in an exemplary embodiment, the data acquisition module 410 is configured to acquire the target sound the data and target vibration data of the to-be-detected washing machine in the following manners:

The device identification information of the to-be-detected washing machine is acquired, and according to the device identification information, a data collection environment of the to-be-detected washing machine is configured.

Sound data and vibration data of the to-be-detected washing machine are collected in the data collection environment to obtain the target sound data and the target vibration data of the to-be-detected washing machine.

Based on the preceding embodiments, in an exemplary embodiment, acquiring the device identification information of the to-be-detected washing machine, and according to the device identification information, configuring the data collection environment of the to-be-detected washing machine includes the steps described below.

A barcode image of a washing machine by using an image collection device is collected, the barcode image to a machine vision system is transmitted, and the device identification information of the to-be-detected washing machine is acquired.

The data collection environment of the to-be-detected washing machine is configured according to the acquired device identification information of the to-be-detected washing machine, and it is determined whether the currently configured data collection environment satisfies a collection condition.

The target sound data and the target vibration data of the to-be-detected washing machine are collected when determining that the currently configured data collection environment satisfies the collection condition. Alternatively, a collection environment is reconfigured until the collection condition is satisfied when determining that the currently configured data collection environment does not satisfy the collection condition.

Determining whether the currently configured data collection environment satisfies the collection condition includes determining whether a sampling frequency, a sampling digit, and ambient noise of the to-be-detected washing machine satisfy a preset collection condition.

Based on the preceding embodiments, alternatively, the data analysis module 420 is configured to select the matching sound analysis algorithm and the matching vibration analysis algorithm to analyze the target sound data and the target vibration data according to device identification information of the to-be-detected washing machine in the following manners:

Vibration detection is performed on the base of the to-be-detected washing machine fixed by a hydraulic apparatus in the to-be-detected washing machine to acquire base vibration data of the washing machine, and model information of the base of the to-be-detected washing machine is acquired by the radio frequency identification technology.

The collected base vibration data are compared with historical base vibration data in a data library, and it is determined whether the collected base vibration data matches the historical base vibration data.

When determining that the collected base vibration data matches the historical base vibration data, the base vibration data are analyzed.

When determining that the collected base vibration data does not match the historical base vibration data, the base vibration data are eliminated, and the historical base vibration data are used as new base vibration data to obtain the target vibration data of the to-be-detected washing machine.

Based on the preceding embodiments, in an exemplary embodiment, analyzing the target sound data and the target vibration data includes selecting the matching sound analysis algorithm to perform chromatogram analysis on the target sound data to generate the sound data analysis result; selecting the matching vibration analysis algorithm to perform envelope analysis on the target vibration data to generate the vibration data analysis result.

Based on the preceding embodiments, in an exemplary embodiment, the abnormal sound position and cause determination module 430 is configured to determine the position at which the abnormal sound is generated in the to-be-detected washing machine and the cause of the abnormal sound according to the sound data analysis result and the vibration data analysis result in the following manners:

It is determined that the to-be-detected washing machine is substandard when determining that at least one of the sound data analysis result or the vibration data analysis result is unacceptable.

The position at which the abnormal sound is generated in the to-be-detected washing machine and the cause of the abnormal sound are determined according to the sound data analysis result, the vibration data analysis result, and a mechanism model of the to-be-detected washing machine.

The mechanism model of the to-be-detected washing machine includes an accurate distribution of multiple structures of a washing machine.

Based on the preceding embodiments, in an exemplary embodiment, determining that the to-be-detected washing machine is substandard when determining that at least one of the sound data analysis result or the vibration data analysis result is unacceptable includes uploading information of the substandard to-be-detected washing machine to a manufacturing execution system and a database, and storing the information of the substandard to-be-detected washing machine; where the information of the substandard to-be-detected washing machine at least includes the device identification information, data collection environment information, the target sound data, the target vibration data, the sound data analysis result, and the vibration data analysis result; maintaining the substandard to-be-detected washing machine according to the position at which the abnormal sound is generated in the to-be-detected washing machine and the cause of the abnormal sound.

Based on the preceding embodiments, in an exemplary embodiment, the abnormal sound position and cause determination module 430 is further configured to determine the position at which the abnormal sound is generated in the to-be-detected washing machine and the cause of the abnormal sound according to the sound data analysis result and the vibration data analysis result in the following manners:

It is determined that the to-be-detected washing machine is up to standard when determining that both the sound data analysis result and the vibration data analysis result are acceptable.

Information of the to-be-detected washing machine that is up to standard is uploaded to a manufacturing execution system and a database, and the information of the to-be-detected washing machine that is up to standard is stored. The information of the washing machine that is up to standard at least includes the device identification information, data collection environment information, the target sound data, the target vibration data, the sound data analysis result, and the vibration data analysis result.

The preceding apparatus may execute the washing machine abnormal sound detection method provided by any embodiment of the present application and has corresponding functional modules and beneficial effects of executing the method.

Embodiment Five

Figure 5:
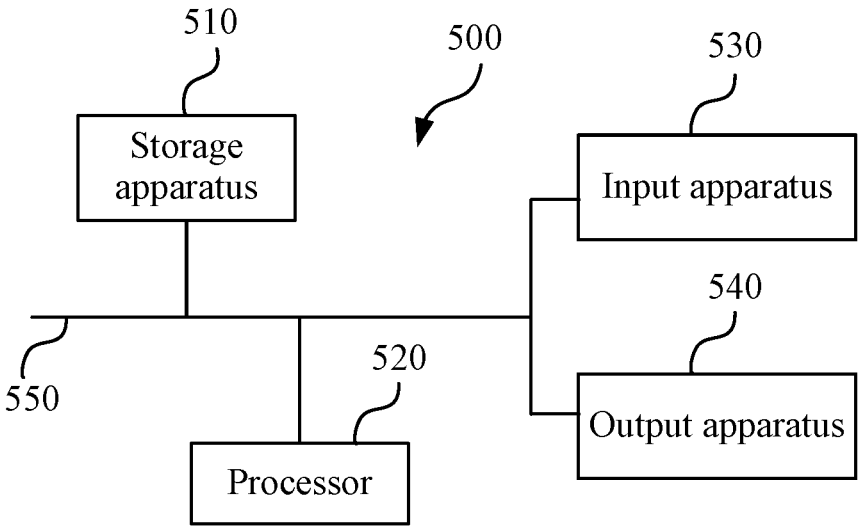
FIG. 5 is a diagram illustrating the structure of an electronic device according to embodiment five of the present application.

FIG. 5 is a diagram illustrating the structure of an electronic device according to embodiment five of the present application. This embodiment of the present application provides an electronic device, which may integrate a washing machine abnormal sound detection interactive apparatus according to embodiments of the present application. As shown in FIG. 5, the embodiment of the present application provides an electronic device 500. The electronic device 500 includes one or more processors 520 and a storage apparatus 510. The storage apparatus 510 is configured to store one or more programs. When executed by the one or more processors 520, the one or more programs cause the one or more processors 520 to perform the washing machine abnormal sound detection method according to embodiments of the present application.

The method includes acquiring target sound data and target vibration data of a to-be-detected washing machine; selecting a matching sound analysis algorithm and a matching vibration analysis algorithm to analyze the target sound data and the target vibration data according to device identification information of the to-be-detected washing machine; determining a position at which an abnormal sound is generated in the to-be-detected washing machine and a cause of the abnormal sound according to the sound data analysis result and the vibration data analysis result.

Those skilled in the art may understand that the processor 520 may also implement solutions of the washing machine abnormal sound detection method according to any embodiment of the present application.

The electronic device 500 shown in FIG. 5 is only an example.

As shown in FIG. 5, the electronic device 500 includes a processor 520, a storage apparatus 510, an input apparatus 530, and an output apparatus 540. One or more processors 520 may be disposed in the electronic device, and one processor 520 is used as an example in FIG. 5. The processor 520, the storage apparatus 510, the input apparatus 530, and the output apparatus 540 in the electronic device may be connected by a bus or in other manners. Connection by a bus is used as an example in FIG. 5.

As a computer-readable storage medium, the storage apparatus 510 may be configured to store a software program, a computer executable program, and a module unit, for example, program instructions corresponding to the washing machine abnormal sound detection method in the embodiments of the present application.

The storage apparatus 510 may mainly include a program storage area and a data storage area. The program storage region may store an operating system and an application program required for at least one function. The data storage region may store data or the like created according to the use of the terminal. In addition, the storage apparatus 510 may include a high-speed random-access memory and may also include a nonvolatile memory such as at least one disk memory, flash memory, or other nonvolatile solid-state memories. In some examples, the storage apparatus 510 may include memories that are remotely disposed with respect to the processor 520. These remote memories may be connected via a network. Examples of the preceding network include the Internet, an intranet, a local area network, a mobile communication network, and a combination thereof.

The input apparatus 530 may be configured to receive inputted digital, character information, or voice information and generate key signal input related to user settings and function control of the electronic device. The output apparatus 540 may include electronic devices such as a display screen and a speaker.

The electronic device provided in the embodiment of the present application can determine the position and cause of the abnormal sound and improve the accuracy of detecting abnormal sound.

Embodiment Six

This embodiment six of the present application also provides a storage medium including computer-executable instructions which, when executed by a computer processor, executes a washing machine abnormal sound detection method.

The method includes acquiring target sound data and target vibration data of a to-be-detected washing machine; selecting a matching sound analysis algorithm and a matching vibration analysis algorithm to analyze the target sound data and the target vibration data according to device identification information of the to-be-detected washing machine; determining a position at which an abnormal sound is generated in the to-be-detected washing machine and a cause of the abnormal sound according to the sound data analysis result and the vibration data analysis result.

In an exemplary embodiment, when executed by a processor, the program may also be used for executing the washing machine abnormal sound detection method according to any embodiment of the present application.

A computer storage medium in this embodiment of the present application may adopt any combination of one or more computer-readable media. The computer-readable medium may be a computer-readable signal medium or a computer-readable storage medium. The computer-readable storage medium may be an electrical, magnetic, optical, electromagnetic, infrared or semiconductor system, apparatus or device, or any combination thereof. The computer-readable storage medium may include an electrical connection having one or more wires, a portable computer disk, a hard disk, a random-access memory (RAM), a read-only memory (ROM), an erasable programmable read-only memory (EPROM), a flash memory, an optical fiber, a portable compact disc read-only memory (CD-ROM), an optical memory, a magnetic memory, or any suitable combination thereof. The computer-readable storage medium may be any tangible medium including or storing a program. The program may be used by or used in conjunction with an instruction execution system, apparatus, or device.

The computer-readable signal medium may include a data signal propagated in a baseband or as part of a carrier. The data signal carries computer-readable program codes. This propagated data signal may take multiple forms including an electromagnetic signal, an optical signal, or any suitable combination thereof. The computer-readable signal medium may also be any computer-readable medium other than a computer-readable storage medium. The computer-readable medium may send, propagate, or transmit programs for use by or in conjunction with an instruction execution system, apparatus, or device.

The program codes included on the computer-readable medium may be transmitted on any suitable medium including, but not limited to, a wireless medium, a wire, an optical cable, a radio frequency (RF), or any suitable combination thereof.

Computer program codes for performing the operations of the present application may be written in one or more programming languages or combination thereof, including object-oriented programming languages such as Java, Smalltalk, C++, as well as conventional procedural programming languages such as "C" or similar programming languages. The program codes may be executed entirely on a user computer, partly on a user computer, as a stand-alone software package, partly on a user computer and partly on a remote computer, or entirely on a remote computer or a server. In the case relating to a remote computer, the remote computer may be connected to a user computer via any kind of network including a local area network (LAN) or a wide area network (WAN), or may be connected to an external computer (for example, via the Internet by an Internet service provider).

In the description of the specification, the description of reference terms "an embodiment", "some embodiments", "example", "specific example", or "some examples", and the like means a specific characteristic, a structure, a material, or a feature described in connection with the embodiment or the example are included in at least one embodiment or example of the present application. In the specification, the illustrative description of the preceding terms does not necessarily refer to the same embodiment or example. Moreover, the described specific characteristics, structures, materials, or features may be combined properly in one or more embodiments or examples.

What is claimed is:

1. A washing machine abnormal sound detection method, comprising:

acquiring, by at least one sensor in a to-be-detected washing machine, target sound data and target vibration data of the to-be-detected washing machine;

according to device identification information of the to-be-detected washing machine, selecting, by an abnormal sound detection algorithm platform, a matching sound analysis algorithm and a matching vibration analysis algorithm stored in the abnormal sound detection algorithm platform, performing chromatogram analysis on the target sound data to generate a sound data analysis result; and performing envelope analysis on the target vibration data to generate a vibration data analysis result; and determining, by a processor in the to-be-detected washing machine, a position at which an abnormal sound is generated in the to-be-detected washing machine and a cause of the abnormal sound according to the sound data analysis result and the vibration data analysis result;

wherein acquiring, by the at least one sensor, the target vibration data of the to-be-detected washing machine comprises:

detecting vibration of a base of the to-be-detected washing machine fixed by a hydraulic apparatus in the to-be-detected washing machine to acquire base vibration data of the to-be-detected washing machine, and acquiring model information of the base of the to-be-detected washing machine by a radio frequency identification technology;

comparing the collected base vibration data with historical base vibration data in a data library, and determining whether the collected base vibration data matches the historical base vibration data; and in response to determining that the collected base vibration data matches the historical base vibration data, analyzing the base vibration data; or in response to determining that the collected base vibration data does not match the historical base vibration data, eliminating the base vibration data, and using the historical base vibration data as new base vibration data to obtain the target vibration data of the to-be-detected washing machine.

2. The method of claim 1, wherein acquiring, by the at least one sensor, the target sound data and the target vibration data of the to-be-detected washing machine comprises:

acquiring the device identification information of the to-be-detected washing machine, and according to the device identification information, configuring a data collection environment of the to-be-detected washing machine; and collecting sound data and vibration data of the to-be-detected washing machine in the data collection environment to obtain the target sound data and the target vibration data of the to-be-detected washing machine.

3. The method of claim 2, wherein acquiring the device identification information of the to-be-detected washing machine, and according to the device identification information, configuring the data collection environment of the to-be-detected washing machine comprises:

collecting a barcode image of a washing machine by using an image collection device, transmitting the barcode image to a machine vision system, and acquiring the device identification information of the to-be-detected washing machine;

configuring the data collection environment of the to-be-detected washing machine according to the acquired device identification information of the to-be-detected washing machine, and determining whether the currently configured data collection environment satisfies a collection condition; and collecting the target sound data and the target vibration data of the to-be-detected washing machine in response to determining that the currently configured data collection environment satisfies the collection condition; or reconfiguring a collection environment until the collection condition is satisfied in response to determining that the currently configured data collection environment does not satisfy the collection condition;

wherein determining whether the currently configured data collection environment satisfies the collection condition comprises: determining whether a sampling frequency, a sampling digit, and ambient noise of the to-be-detected washing machine satisfy a preset collection condition.

4. The method of claim 1, wherein determining, by the processor, the position at which the abnormal sound is generated in the to-be-detected washing machine and the cause of the abnormal sound according to the sound data analysis result and the vibration data analysis result comprises:

determining that the to-be-detected washing machine is substandard in response to determining that at least one of the sound data analysis result or the vibration data analysis result is unacceptable; and determining the position at which the abnormal sound is generated in the to-be-detected washing machine and the cause of the abnormal sound according to the sound data analysis result, the vibration data analysis result, and a mechanism model of the to-be-detected washing machine;

wherein the mechanism model of the to-be-detected washing machine comprises an accurate distribution of a plurality of structures of a washing machine.

5. The method of claim 4, after determining that the to-be-detected washing machine is substandard in response to determining that at least one of the sound data analysis result or the vibration data analysis result is unacceptable, the method further comprising:

uploading information of the substandard to-be-detected washing machine to a manufacturing execution system and a database, and storing the information of the substandard to-be-detected washing machine; wherein the information of the substandard to-be-detected washing machine at least comprises: the device identification information, data collection environment information, the target sound data, the target vibration data, the sound data analysis result, and the vibration data analysis result; and maintaining the substandard to-be-detected washing machine according to the position at which the abnormal sound is generated in the to-be-detected washing machine and the cause of the abnormal sound.

6. The method of claim 1, wherein determining, by the processor, the position at which the abnormal sound is generated in the to-be-detected washing machine and the cause of the abnormal sound according to the sound data analysis result and the vibration data analysis result comprises:

determining that the to-be-detected washing machine is up to standard in response to determining that both the sound data analysis result and the vibration data analysis result are acceptable; and uploading information of the to-be-detected washing machine that is up to standard to a manufacturing execution system and a database, and storing the information of the to-be-detected washing machine that is up to standard; wherein the information of the to-be-detected washing machine that is up to standard at least comprises: the device identification information, data collection environment information, the target sound data, the target vibration data, the sound data analysis result, the vibration data analysis result.

7. A to-be-detected washing machine, comprising a memory, a processor, and a computer program stored in the memory and runnable on the processor, wherein when executing the computer program, the processor is caused to implement:

acquiring target sound data and target vibration data of a to-be-detected washing machine by using at least one sensor in the to-be-detected washing machine;

determining a position at which an abnormal sound is generated in the to-be-detected washing machine and a cause of the abnormal sound according to a sound data analysis result and a vibration data analysis result, wherein the sound analysis result is generated by an abnormal sound detection algorithm platform through selecting a matching sound analysis algorithm and performing chromatogram analysis on the target sound data according to device identification information of the to-be-detected washing machine; the vibration data analysis result is generated by the abnormal sound detection algorithm platform through selecting a matching vibration analysis algorithm and performing envelope analysis on the target vibration data according to the device identification information; and the matching sound analysis algorithm and the matching vibration analysis algorithm are stored in the abnormal sound detection algorithm platform;

wherein acquiring the target vibration data of the to-be-detected washing machine by using the at least one sensor comprises:

detecting vibration of a base of the to-be-detected washing machine fixed by a hydraulic apparatus in the to-be-detected washing machine to acquire base vibration data of the to-be-detected washing machine, and acquiring model information of the base of the to-be-detected washing machine by a radio frequency identification technology;

comparing the collected base vibration data with historical base vibration data in a data library, and determining whether the collected base vibration data matches the historical base vibration data; and in response to determining that the collected base vibration data matches the historical base vibration data, analyzing the base vibration data; or in response to determining that the collected base vibration data does not match the historical base vibration data, eliminating the base vibration data, and using the historical base vibration data as new base vibration data to obtain the target vibration data of the to-be-detected washing machine.

8. The washing machine of claim 7, wherein the processor is caused to acquire the target sound data and the target vibration data of the to-be-detected washing machine by using the at least one sensor in the following manners:

acquiring the device identification information of the to-be-detected washing machine, and according to the device identification information, configuring a data collection environment of the to-be-detected washing machine; and collecting sound data and vibration data of the to-be-detected washing machine in the data collection environment to obtain the target sound data and the target vibration data of the to-be-detected washing machine.

9. The washing machine of claim 8, wherein the processor is caused to acquire the device identification information of the to-be-detected washing machine, and according to the device identification information, configuring the data collection environment of the to-be-detected washing machine in the following manners:

collecting a barcode image of a washing machine by using an image collection device, transmitting the barcode image to a machine vision system, and acquiring the device identification information of the to-be-detected washing machine;

configuring the data collection environment of the to-be-detected washing machine according to the acquired device identification information of the to-be-detected washing machine, and determining whether the currently configured data collection environment satisfies a collection condition; and collecting the target sound data and the target vibration data of the to-be-detected washing machine in response to determining that the currently configured data collection environment satisfies the collection condition; or reconfiguring a collection environment until the collection condition is satisfied in response to determining that the currently configured data collection environment does not satisfy the collection condition;

wherein determining whether the currently configured data collection environment satisfies the collection condition comprises: determining whether a sampling frequency, a sampling digit, and ambient noise of the to-be-detected washing machine satisfy a preset collection condition.

10. The washing machine of claim 7, wherein the processor is caused to determine the position at which the abnormal sound is generated in the to-be-detected washing machine and the cause of the abnormal sound according to the sound data analysis result and the vibration data analysis result in the following manners:

determining that the to-be-detected washing machine is substandard in response to determining that at least one of the sound data analysis result or the vibration data analysis result is unacceptable; and determining the position at which the abnormal sound is generated in the to-be-detected washing machine and the cause of the abnormal sound according to the sound data analysis result, the vibration data analysis result, and a mechanism model of the to-be-detected washing machine;

wherein the mechanism model of the to-be-detected washing machine comprises an accurate distribution of a plurality of structures of a washing machine.

11. The washing machine of claim 10, wherein after determining that the to-be-detected washing machine is substandard in response to determining that at least one of the sound data analysis result or the vibration data analysis result is unacceptable, the processor is further caused to implement:

uploading information of the substandard to-be-detected washing machine to a manufacturing execution system and a database, and storing the information of the substandard to-be-detected washing machine; wherein the information of the substandard to-be-detected washing machine at least comprises: the device identification information, data collection environment information, the target sound data, the target vibration data, the sound data analysis result, and the vibration data analysis result; and maintaining the substandard to-be-detected washing machine according to the position at which the abnormal sound is generated in the to-be-detected washing machine and the cause of the abnormal sound.

12. The washing machine of claim 7, wherein the processor is caused to determine the position at which the abnormal sound is generated in the to-be-detected washing machine and the cause of the abnormal sound according to the sound data analysis result and the vibration data analysis result in the following manners:

determining that the to-be-detected washing machine is up to standard in response to determining that both the sound data analysis result and the vibration data analysis result are acceptable; and uploading information of the to-be-detected washing machine that is up to standard to a manufacturing execution system and a database, and storing the information of the to-be-detected washing machine that is up to standard; wherein the information of the to-be-detected washing machine that is up to standard at least comprises: the device identification information, data collection environment information, the target sound data, the target vibration data, the sound data analysis result, the vibration data analysis result.

13. A non-transitory storage medium comprising computer-executable instructions which, when executed by a computer processor, cause the computer processor to implement:

acquiring target sound data and target vibration data of a to-be-detected washing machine by using at least one sensor in the to-be-detected washing machine;

determining a position at which an abnormal sound is generated in the to-be-detected washing machine and a cause of the abnormal sound according to a sound data analysis result and a vibration data analysis result, wherein the sound data analysis result is generated by an abnormal sound detection algorithm platform through selecting a matching sound analysis algorithm and performing chromatogram analysis on the target sound data according to device identification information of the to-be-detected washing machine; the vibration data analysis result is generated by the abnormal sound detection algorithm platform through selecting a matching vibration analysis algorithm and performing envelope analysis on the target vibration data according to the device identification information; and the matching sound analysis algorithm and the matching vibration analysis algorithm are stored in the abnormal sound detection algorithm platform;

wherein acquiring the target vibration data of the to-be-detected washing machine by using the at least one sensor comprises:

detecting vibration of a base of the to-be-detected washing machine fixed by a hydraulic apparatus in the to-be-detected washing machine to acquire base vibration data of the to-be-detected washing machine, and acquiring model information of the base of the to-be-detected washing machine by a radio frequency identification technology;

comparing the collected base vibration data with historical base vibration data in a data library, and determining whether the collected base vibration data matches the historical base vibration data; and in response to determining that the collected base vibration data matches the historical base vibration data, analyzing the base vibration data; or in response to determining that the collected base vibration data does not match the historical base vibration data, eliminating the base vibration data, and using the historical base vibration data as new base vibration data to obtain the target vibration data of the to-be-detected washing machine.

14. The storage medium of claim 13, wherein the computer processor is caused to acquire the target sound data and the target vibration data of the to-be-detected washing machine by using the at least one sensor in the following manners:

acquiring the device identification information of the to-be-detected washing machine, and according to the device identification information, configuring a data collection environment of the to-be-detected washing machine; and collecting sound data and vibration data of the to-be-detected washing machine in the data collection environment to obtain the target sound data and the target vibration data of the to-be-detected washing machine.

15. The storage medium of claim 14, wherein the computer processor is caused to acquire the device identification information of the to-be-detected washing machine, and according to the device identification information, configuring the data collection environment of the to-be-detected washing machine in the following manners:

collecting a barcode image of a washing machine by using an image collection device, transmitting the barcode image to a machine vision system, and acquiring the device identification information of the to-be-detected washing machine;

configuring the data collection environment of the to-be-detected washing machine according to the acquired device identification information of the to-be-detected washing machine, and determining whether the currently configured data collection environment satisfies a collection condition; and collecting the target sound data and the target vibration data of the to-be-detected washing machine in response to determining that the currently configured data collection environment satisfies the collection condition; or reconfiguring a collection environment until the collection condition is satisfied in response to determining that the currently configured data collection environment does not satisfy the collection condition;

wherein determining whether the currently configured data collection environment satisfies the collection condition comprises: determining whether a sampling frequency, a sampling digit, and ambient noise of the to-be-detected washing machine satisfy a preset collection condition.

* * * * *